US006025316A

United States Patent [19]

Cao et al.

[11] Patent Number: 6,025,316

[45] Date of Patent: Feb. 15, 2000

[54] DETERGENT COMPOSITION HAVING IMPROVED CLEANING POWER

[75] Inventors: Hoai-Chau Cao, Liege; Marie-Christine Houben, Alleur; Patricia Pagnoul, Fooz; Patrick Durbut, Verviers; Guy Broze, Grace-Hollogne; Anne-Marie Misselyn, Villers-l'eveque, all of Belgium

[73] Assignee: Colgate-Palmolive Co., New York, N.Y.

[21] Appl. No.: 08/999,820

[22] Filed: Dec. 29, 1997

Related U.S. Application Data

[63] Continuation-in-part of application No. 08/692,660, Aug. 6, 1996, abandoned, which is a continuation-in-part of application No. 08/662,384, Jun. 13, 1996, abandoned.

[60] Provisional application No. 60/009,346, Dec. 27, 1995.

[51] Int. Cl.[7] ..... C11D 3/37; C11D 3/386

[52] U.S. Cl. ..... 510/360; 510/320; 510/321; 510/337; 510/340; 510/351; 510/353; 510/356; 510/361; 510/475; 510/500

[58] Field of Search ..... 510/360, 475, 510/500, 300, 320, 321, 351, 337, 340, 353, 356, 361

[56] References Cited

U.S. PATENT DOCUMENTS

| | | | |
|---|---|---|---|
| 5,512,699 | 4/1996 | Connor et al. | 564/153 |
| 5,723,425 | 3/1998 | Cauwberghs et al. | 510/299 |

OTHER PUBLICATIONS

Chemical Abstract accession No. 1987:409389, for JP 61288000, Dec. 18, 1986.

*Primary Examiner*—Ardith Hertzog
*Attorney, Agent, or Firm*—Bernard Lieberman

[57] ABSTRACT

Detergent composition are disclosed which are formulated for use in wash water over a wide range of pH in the washing bath. The compositions contain an anionic surfactant, optionally in combination with a nonionic surfactant with optimal builders and enzymes, and also contain at least one water soluble organic polymer, such as polyethylene glycol, which is miscible with or soluble in the surfactant. The presence of the water soluble polymer leads to enhanced fabric cleaning performance.

16 Claims, 2 Drawing Sheets

| | | | |
|---|---|---|---|
| SKIN OIL | 23.8 | 20.51 | 24.74 |
| SALAD DRESSING | 4.26 | 3.46 | 5.53 |
| KREFELD | 12.26 | 10.57 | 12.6 |

| | | | |
|---|---|---|---|
| SKIN OIL | 23.8 | 20.51 | 24.74 |
| SALAD DRESSING | 4.26 | 3.46 | 5.53 |
| KREFELD | 12.26 | 10.57 | 12.6 |

| | | | |
|---|---|---|---|
| COCOA | 22.95 | 15.62 | 24.44 |
| GROUNDNUT | 24.7 | 15.55 | 25.56 |
| BLOOD | 37.52 | 27.01 | 36.95 |

DETERGENT COMPOSITION HAVING IMPROVED CLEANING POWER

This application is a continuation-in-part of U.S. application Ser. No. 08/692,660 filed Aug. 6, 1996 now abandoned which is a continuation-in-part of U.S. application Ser. No. 08/662,384 filed Jun. 13, 1996 now abandoned which claims priority from U.S. Provisional application 60/009,346 filed Dec. 27, 1995, the disclosure of which is incorporated herein by reference.

BACKGROUND OF THE INVENTION

1. Field of the Invention

This invention relates to detergent compositions.

2. Description of Related Art

Detergent compositions, particularly liquid laundry and/or dishwasher detergents, are generally formulated to contain one or more anionic surfactant materials, builder materials, electrolyte materials and other adjuvants dispersed or dissolved in an aqueous medium. They are generally formulated at an alkaline pH of above 7, e.g., 8–12, and generally contain buffer ingredients and/or builder materials which will maintain an alkaline pH in both the detergent composition if it is a liquid, and in the wash water to which the detergent composition is added.

The main reason for the development of basic pH is to insure that the anionic surfactant components, enzymes or other organic components present in the composition remain solubilized and dispersed in the wash water and that greasy or oily stains removed from soiled clothing are also dispersed in the wash water.

An example of a liquid detergent composition is found in U.S. Pat. No. 5,108,644 which discloses a liquid detergent concentrate comprising a mixture of nonionic polyalkoxylated anionic surfactants, a salting out electrolyte/builder and a water soluble, viscosity reducing polymer which may be a polyethylene glycol. The composition is formulated to have an alkaline pH of around 11, as shown in Table II.

In an attempt to provide effective cleaning for a wide variety of soils and stains, most premium commercial liquid laundry detergents are formulated to contain about 30%, by weight, or more of active ingredients, predominantly surfactants and builders, often including minor amounts of enzyme. At active ingredient levels below about 25%, and particularly below about 20%, commercial liquid laundry detergents are formulated to provide a less costly product to the consumer, while being generally less efficacious for cleaning the wide array of soils and stains which are capable of being laundered by the premium liquid detergents at normal dosage.

Accordingly, there remains a need in the detergent industry to provide a laundry detergent composition which can provide a highly effective cleaning performance at reduced levels of active ingredients but which is comparable to the performance of conventional heavy duty detergents having significantly higher levels of active ingredients.

SUMMARY OF THE INVENTION

The present invention provides detergent compositions comprising a mixture of:

a) at least about 5 wt % of a surfactant comprising an anionic surfactant and optionally a nonionic surfactant; said detergent composition being free of a quaternary nitrogen-containing cationic compound;

b) from 0 up to about 5 wt % of at least one enzyme; and c) at least about 0.1 wt % of a water soluble organic polymer which is miscible with or soluble in said surfactant; said composition providing a cleaning performance in the wash bath due to the presence of the organic polymer which is superior to the cleaning provided by an otherwise identical detergent composition which is free of said water soluble organic polymer.

In accordance with one aspect of the invention, the detergent compositions are formulated to contain less than about 25% by weight of active ingredients, and preferably about 20% or less of active ingredients which as herein defined comprises surfactant, builder, polymer and enzyme, if present.

The invention also provides for a method for washing fabrics comprising forming a dilute aqueous solution of the detergent composition described above and then subjecting fabric material to washing action in said aqueous solution.

DETAILED DESCRIPTION OF THE INVENTION

Figure 1:
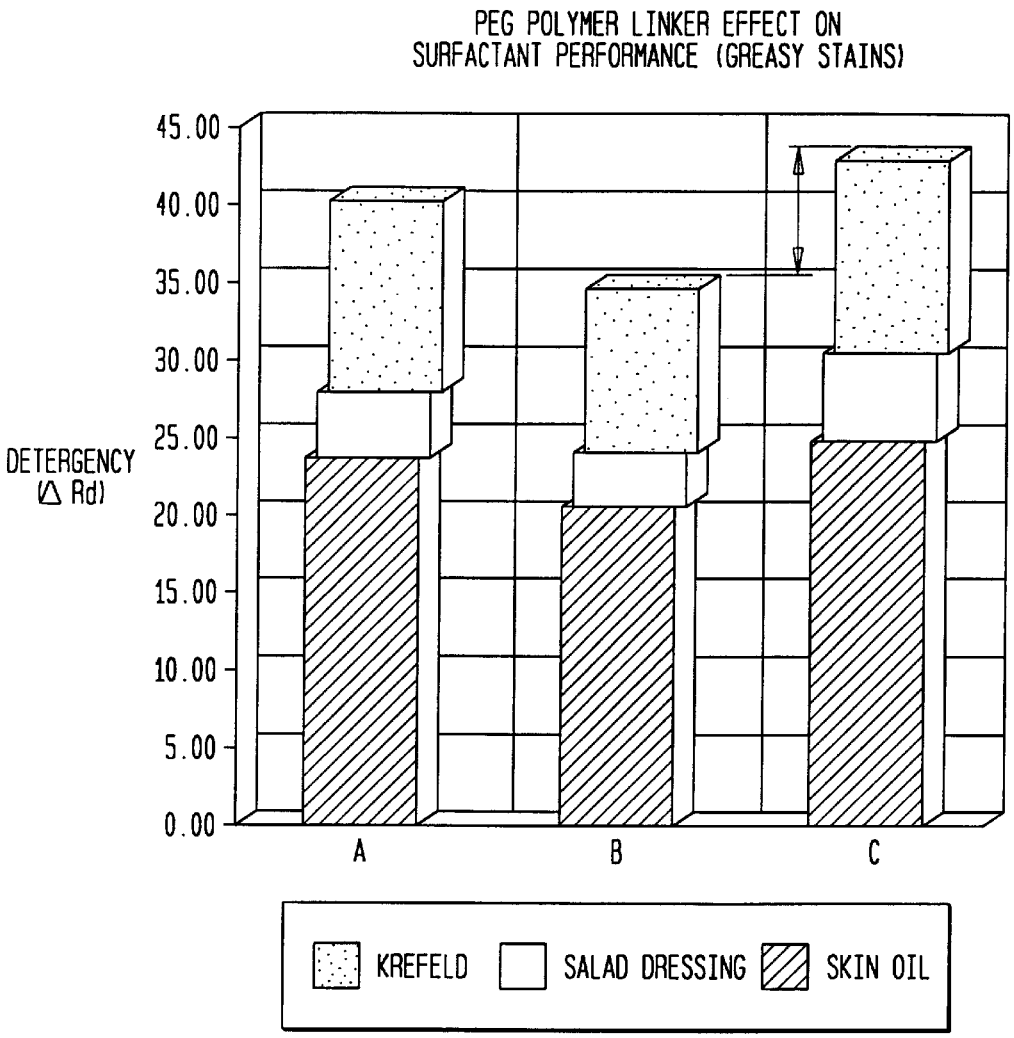
FIG. 1 and FIG. 2 are graphs depicting the degree of removal of various stains from fabric using a conventional washing detergent as compared with acidic washing detergents with and without the water soluble organic polymer component of this invention.

The detergent compositions of the invention are able to deliver higher proportions of surfactant to fabrics washed in a wash bath containing such detergent composition. This results in enhanced cleaning performance relative to fabrics washed with an otherwise identical detergent composition but which does not contain the aforesaid water soluble organic polymer.

The key to improved cleaning performance in accordance with this invention is the presence in the detergent composition of a water soluble organic polymer which is miscible with optional enzymes which may be present in the composition. Although the water soluble polymers are not themselves known as active cleaning agents, these polymer molecules have an affinity for both the active ingredients and the fabric surface. They thus serve to "link" surfactant and/or enzyme molecules and the fiber surfaces of fabrics being washed, thereby carrying these actives into closer and more intimate contact with such surfaces. This allows effective cleaning to be carried out over a wide range of pH in the washing bath, from slightly acid up to highly alkaline aqueous medium.

Applicants do not wish to be bound to any particular theory of operation concerning the invention insofar as the exact mechanism by which the water soluble organic polymers improve cleaning performance of fabric in the wash medium is not precisely known. However, it is believed that these polymers form hydrogen bonds by electron resonance involving oxygen atoms and/or hydroxyl groups present in the linker polymer and the hydrogen present in the non-neutralized acidic functionalities of the surfactants and enzymes, as well as with ether functionalities which may be present in alkoxylated surfactants. In turn, linker polymers containing oxygen in the polymer structure tend to similarly form hydrogen bonds with hydroxyl or other polar functional groups present in the fabric being washed, e.g., hydroxyl groups present in the glucose structure of cotton or rayon fibers. This hydrogen bonding effect is believed to readily occur at an acidic or near neutral pH and occurs to a lesser extent at a more basic pH because of neutralization of the anionic functionalities of the surfactants and/or enzymes at basic pH.

Thus, the water soluble organic polymers useful in the present invention are those which are capable of forming hydrogen bonds with the surfactants and/or enzymes present in the detergent composition at an acidic nor near neutral pH. Such polymers include polyvinyl alcohols, alkoxylated polyhydric alcohols, polycellulose (e.g. carboxy methyl cellulose), polysaccharides, polyalkylene glycols, vinyl pyrrolidone polymers and like materials containing hydroxyl, ether and/or anhydride functionalities.

Useful alkoxylated polyhydric alcohols are represented by the formula:

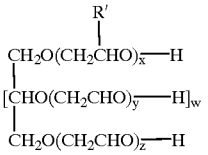

wherein w equals one to four and x, y and z have a value between 0 and 60, more preferably 0 to 40, provided that (x+y+z) equals about 2 to about 100, preferably about 4 to about 24 and most preferably about 4 to about 19, and wherein R' is either hydrogen atom or methyl group. A preferred ethoxylated polyhydric alcohol is glycerol 6EO.

Polyvinyl pyrrolidone for use in the present invention is depicted by the formula:

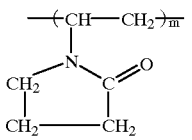

wherein m is about 20 to about 350 more preferably about 70 to about 110.

Preferred organic polymers which are both water soluble and are miscible with or soluble in an ionic surfactants include polyethylene glycol, polypropylene glycol and mixtures thereof having a molecular weight in the range of from about 200 to 20,000, preferably from about 500 to 10,000 and most preferably from about 500 to 5,000. Other preferred polymers include vinylpyrrolidone polymers, which includes polyvinylpyrrolidone as well as water soluble copolymers of vinylpyrrolidone with up to 50 mole % of copolymerizable unsaturated hydrophilic monomers such as acrylic monomers. The molecular weight of the vinyl pyrrolidone polymers may range from about 4,000 to 200,000, more preferably from about 10,000 to 50,000.

The organic polymer is present in the composition in an amount sufficient to enhance the cleaning performance of the detergent composition generally at a level of from about 0.1 to about 5 wt %, more preferably at a level of from about 0.25 to 2.5 wt %.

The function of the organic polymer in the detergent compositions of the invention is fundamentally distinct from the use of polymers such as polyethylene glycol in liquid detergent compositions described in the prior art. For example, in U.S. Pat. No. 5,108,644, polymer such as polyethylene glycols, polyacrylates and polyacrylate/maleic co-polymers are disclosed as additives to certain structural liquid detergents for the purpose of reducing viscosity in the liquid composition. In contrast thereto, in the compositions of the present invention, the polymer enhances the performance and activity of the surfactant, the provides no viscosity reduction or builder effect or anti-encrustation effect, the characteristic function of conventional polymer additives to laundry detergent compositions known in the art.

The detergent composition also contains at least about 5 wt % of an anionic surfactant, or optionally in combination with a nonionic surfactant. A mixture of an anionic and nonionic surfactant is often preferred from the standpoint of efficient cleaning.

Suitable anionic surfactants include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$ $C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic surfactants are ($C_{10}$–$C_{18}$) alkyl polyethoxy (1–11 Eo) sulfates and mixtures thereof having differing water solubilities.

Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. Other so-called nonionic surfactant compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethoxylated sorbitans and ethoxylated phosphate esters.

The preferred non-ionic surfactant compounds are those of the ethoxylated and mixed ethoxylated-propyloxylated ($C_6$–$C_{18}$) fatty alcohol type, containing 2–11 EO groups.

Examples of amphoteric surfactants which can be used in the compositions of the present invention are betaines and those which can be broadly described as derivatives of aliphatic secondary and tertiary amines in which the aliphatic radical can be straight chain or branched and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium 3-dodecylaminopropane sulfonate, N-alkyltaurines, such as prepared by reacting dodecylamine with sodium isothionate, N-higher alkyl aspartic acids and the products sold under the trade name "Miranol".

Examples of betaines useful herein include alkylamido betaines, alkylamine betaines, alkyl betaines and sulfobetaines. The high alkyl betaines are represented by coco dimethyl carboxymethyl betaine, lauryl dimethyl carboxymethyl betaine, lauryl dimethyl alpha-carboxymethyl betaine, cetyl dimethyl carboxymethyl betaine, lauryl bis(2-hydroxyethyl) carboxy methyl betaine, stearyl bis(2-hydroxypropyl) carboxymethyl betaine, oleyl dimethyl gamma-carboxypropyl betaine, lauryl bis-(2-hydroxypropyl) alpha-carboxymethyl betaine, etc. The sulfobetaines may be represented by coco dimethyl sulfopropyl betaine, stearyl dimethyl sulfopropyl betaine, lauryl bis-(2-hydroxyethyl) sulfopropyl betaine, amino betaine amidosulfobetaines, and the like.

Other suitable betaines include 1-(lauryl, dimethylammonio) acetate-1-(myristyl dimethylammonio) propane-3-sulfonate, 1-(myristyl dimethylamino)-2-hydroxypropane-3-sulfonate, cocoamidoethylbetaine and cocoamidopropylbetaine.

An especially preferred class of amphoteric surfactants are the glycinate derivatives of the formula:

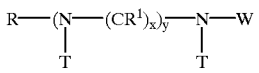

wherein R is a hydrocarbon group, preferably a $C_8$ to $C_{20}$ aliphatic, $R^1$ is hydrogen or a $C_1$ to $C_6$ alkyl, preferably hydrogen or methylene, T is hydrogen or W, preferably W, W is $R^2COOM$ wherein M is hydrogen, alkali metal, alkaline earth metal, ammonium or substituted ammonium, such as lower alkanolamine, e.g., triethanolamine, x is 2 to 3 and y is 2 to 4, and $R^2$ is a $C_1$ to $C_6$ alkylene. A preferred amphoteric surfactant is of the formula

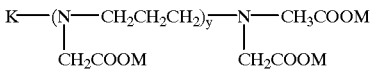

wherein R is an aliphatic hydrocarbon group, preferably a $C_{16}$ to $C_{18}$ fatty alkyl or fatty alkylene, M is alkali metal, and y is 3 to 4. More preferably R is tallowalkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Preferred amphoteric surfactants of this type are available commercially under the trade name Ampholak※7TX obtainable from Kenobel AB, a unit of Nobel Industries, Sweden.

The amount of the surfactant in the composition will generally range from about 5% to about 75%, more usually from about 5% to about 30%, and most preferably from about 8% to about 15% by weight of the composition. In the mixture of anionic and nonanionic surfactants used herein, the anionic surfactant is at least 40% by weight of such mixture.

The nonionic surfactant is used in an amount of from about 0.5 to 10%, preferably from about 1 to 8% by weight and the amphoteric surfactant when present, can comprise from about 0.3 to 15%, preferably 1 to 10%, most preferably from about 1 to 8% by weight, based on the total composition.

A more detailed illustration of the various surfactants and classes of surfactants mentioned may be found in the text *Surface Active Agents,* Vol. II, by Schwartz, Perry and Berch (Interscience Publishers, 1958), in a series of annual publications entitled *McCutcheon's Detergents and Emulsifiers,* issued in 1969, or in *Tenside-Taschenbuch,* H. Stache, 2nd Ed. Carl Hanser Verlag, Munich and Vienna, 1981.

The composition may also contain one or more detergency builders. The selection of particular builders from those known in the art is dictated, in part, by the pH of the liquid detergent composition itself, or the pH which is generates in the wash water. For detergent composition intended to provide an acidic or near neutral wash medium, it is preferred that the builder not be a material that will generate a significantly basic pH above about 7.5, preferably not above 7.0, in the wash water or in the detergent composition itself if it is in the form of a liquid. Thus, known builders such as zeolites are less preferred as the main builder component when operating at low pH conditions because of proton exchange from the acidic detergent medium with the alkali metal, e.g., sodium cation, of the zeolite after a period of storage.

Accordingly, preferred builders at low pH wash water conditions include organic builders, for example, polycarboxylate builders, such as aminopolycarboxylates, for example, sodium and potassium ethylene-diamine tetraacetate; sodium and potassium nitrotriacetate; and the polyacetal polycarboxylates, such as those described, for example, in U.S. Pat. Nos. 4,144,226 and 4,315,092. Other organic builders of the polycarboxylate type include the water-soluble salts, especially sodium and potassium salts, of metallic acid, citric acid, pyromellitic acid, benzene polycarboxylic acids, carboxymethyloxy succinic acid, cis-cyclohexane hexacarboxylic acid, and the like. Citric acid salt, e.g., potassium or sodium citrate, is often a preferred builder in non-phosphate or low phosphate formulations. In liquid detergent compositions, the citric acid salt also serves a dual function as a builder and an electrolyte which helps maintain the surfactant micelles dispersed in the aqueous liquid medium.

Conventional builders may be used for alkaline pH wash water conditions. Such builders include phosphates such as alkali metal polyphosphates, and alkali or alkaline earth metal silicates, carbonates, and bicarbonates, as well as water-insoluble aluminosilicate zeolite, such as zeolite A. Sodium tripolyphosphate is especially preferred but other phosphate builders such as tetrasodium pyrophosphate can also be used. Mixtures of sodium tripolyphosphate and sodium carbonate is disclosed in U.S. Pat. No. 4,842,769 are also useful. The zeolites useful in the present invention include the crystalline, amorphous and mixed crystalline-amorphous zeolites of either natural or synthetic origin. It is preferred that the zeolites rapidly and effectively counteract hardness cations, such as calcium, magnesium, iron and the like to soften the wash water before such hardness ions adversely react with any other components of the detergent composition.

The preferred zeolites have a high calcium ion exchange capacity, normally from about 200 to 400 or more, milliequivalents of calcium carbonate hardness per gram of the aluminosilicate ("meq./g."). It is preferred that the zeolite used has a calcium capacity between about 250 to 350 meq./g.

Although other ion exchanging zeolites may also be utilized, the finely divided synthetic zeolite builder particles preferred in the practice of this invention will have the formula $$(Na_2O)_x(Al_2O_3)_y(SiO_2)_z.wH_2O$$

wherein x is 1, y is from 0.8 to 1.2 (preferably about 1), z is from 1.5 to 3.5 (preferably 2 to 3, and more preferably about 2) and w is from 0 t 9 (preferably 2.5 to 6).

The water insoluble crystalline aluminosilicates used are often characterized by having a network of substantially uniformly sized ports in the range of about 3 to 10 Angstroms, often being about 4 Å (normal). This size is determined by the unit structure of the zeolite crystal. The zeolite should be an univalent cation-exchanging zeolite, i.e., it should be an aluminosilicate of an univalent cation such as sodium, potassium, lithium (when practicable) or other alkali metal, ammonium or hydrogen. Preferably, the univalent cation of the zeolite molecular sieve is an alkali metal cation, preferably sodium or potassium and most preferably sodium. However, other cations are also useful.

Crystalline zeolites that are good ion exchangers for use in the invention, at least in part, include zeolites of the following crystalline structure groups: A, X, Y, L, mordenite and erionite. The A, X and Y types are preferred. These crystalline types of zeolites are well-known in the art and are described in *Zeolite Molecular Sieves* by Donald W. Beck, published in 1974 by John Wiley & Sons. Typical commercially available zeolites of the types mentioned above are listed in Table 9.6, at pages 747–749, of the Beck text, which table is incorporated herein by reference.

Where present, the builder is used at generally low levels of from about 0 to about 25 wt % of the detergent composition, more preferably from about 0 to 10 wt % of said composition.

The detergent composition may also contain one or more enzymes which are active against biodegradable stains, e.g., starches, vegetable and blood, and which are also active at a pH of about 5 to about 12. For detergent compositions intended to provide an acidic or near neutral wash medium, the present invention allows the use of enzymes which ordinarily would not be active at a wash water pH of below about 7.5 but which become active at a lower pH in the present composition because of the presence of the water soluble polymer component. Preferred enzymes which may be used include amylolytic enzymes (alpha amylases), alkaline and neutral proteases, lipolases, cellulases and the like, and mixtures thereof.

Alkaline or neutral proteolytic enzymes suitable for the present composition include the various commercial liquid enzyme preparations which have been adapted for use in detergent compositions. Enzyme preparations in powdered form are also useful although, as a general rule, less convenient for incorporation into a built liquid detergent composition. Thus, suitable liquid enzyme preparations include "Alcalase" and "Savinase", trademarked products sold by Novo Industries, Copenhagen, Denmark, and "Maxatase", "Maxacal", "Maxaperm" and "AZ-Protease" sold by Gist-Brocades, Delft, The Netherlands.

Other suitable alpha-amylase liquid enzyme preparations are those sold by Novo Industries and Gist-Brocades under the tradenames "Termamyl" and "Maxamyl", respectively. Another enzyme preparation which may be used is a powdered enzyme preparation containing alpha-amylase and a mixture of alkaline and neutral proteases available as CRD-Protease from the Monsanto Co. of St. Louis, Mo.

Where used, the enzymes are normally present in the detergent composition at a level of from about 0.01 up to about 5 wt %, more preferably from about 0.1 to 2 wt %.

The composition may also contain a suitable stabilizer system for the enzyme such as up to 1 wt % calcium chloride or the combination of boric acid, boric oxide or alkali metal borate and water soluble calcium salt.

An optional, but often preferred additive, is a higher fatty acid, which may be saturated or unsaturated, and may contain from about 10 to about 23 carbon atoms, preferably from about 12 to 20 carbon atoms. Oleic acid is especially preferred in amounts of from 0.1 to about 10% by weight of the composition. These higher fatty acids function in the detergent compositions as anti foaming agents and also function as soap surfactants in combination with neutralizing cations, e.g., sodium or potassium, present in the composition. They may be used alone for this anti-foaming function but are often used in combination with polysiloxane (silicone) anti-foaming agents. The silicone anti-foaming agents will generally be present in minor amounts compared to the fatty acid. Suitable ratios (by weight) of the fatty acid anti-foaming agent to silicone anti-foaming agent may range from about 100:0 to 1:10, preferably 50:1 to 1:1, especially 30:1 to 2:1.

The detergent composition may also contain one or more softening components known in the art. Suitable softeners include swelling bentonite clays such as sodium and calcium montmorillonites, sodium saponites and sodium hectorites. These may be present in the detergent composition at levels of from about 0.5 to 20 wt %, more preferably from about 5 to 15 wt %.

Other conventional materials may also be present in the liquid detergent compositions of the invention, for example, soil-suspending agents, thickening agents, sequesterants such as salts of ethylene diamine tetraacetic acid or analogous phosphonic acid salts, hydrotropes, corrosion inhibitors, dyes, perfumes, optical brighteners, suds boosters, germicides, e.g., quaternary ammonium salts, preservatives, e.g., quaternium 15, anti-tarnishing agents, opacifiers, oxygen-liberating bleaches such as sodium perborate or percarbonate with or without bleach precursors, buffers and the like. Such other conventional materials may be used in the amounts they are normally used generally up to about 5% by weight, more preferably up to about 3% by weight, although higher amounts which do not interfere with the stability of the composition or give rise to an unacceptably high pH may be used, if desired.

The detergent compositions of the present invention may be in liquid or in granular form. The liquid carrier for the liquid compositions of this invention is preferably water alone, but an aqueous carrier containing minor amounts of a lower alcohol, such as ethanol or isopropanol, may also be used in some cases. Generally, water levels may be up to about 90% by weight of the composition, for example, from about 20% to about 90%, preferably from about 20% to 70%, by weight. The water may be deionized, but usually tap water is sufficient.

The viscosity of the liquid detergent is normally in the range of about 800 to 10,000 centipoises, preferably 2,000–7,000 centipoises, but products of other suitable viscosities may also be useful. At the viscosities mentioned, the liquid detergent is pourable, stable, nonseparating and uniform.

As necessary, pH modifiers, such as water soluble bases, e.g., NaOH, KOH, amines, or ammonia, will be added to obtain the desired pH level. The preferred pH will range from about 5 up to 7.5, more preferably from about 5.0 up to less than 7.0 and most preferably from about 5.5 up to 6.9. Where the detergent composition is in the form of a liquid, the liquid will also exhibit a pH within these specified ranges.

Powder or granular forms of the detergent composition may be prepared by conventional granulation techniques, such as spray drying, wherein a liquid formulation (crutcher slurry) is spray dried and the resulting granular product collected. The crutcher slurry also preferably will contain one or a mixture of granulation aids such as sodium sulfate, silicates, clays and other well known material as such as disclosed in U.S. Pat. Nos. 5,024,778 and 5,332,513. The amount of such granulation aids will generally range from about 10 to 50 wt %. The water content of such granular detergents generally ranges from about 5 to 15 wt %.

The detergent compositions of this invention are suitable for use as laundry detergents, dish water detergents, shampoos, body lotions and the like and may be modified by inclusion of specific known ingredients to accommodate these applications, e.g., dispersing agents, skin conditioning agents, anti-dandruff agents and the like.

Conventional manufacturing methods may be used to formulate the liquid detergent composition. In one procedure, a portion of the aqueous medium may be added to a mixing vessel and the surfactant components may be mixed therewith in any suitable order, followed by addition of builder, acidic components and sufficient neutralizing base, e.g., KOH, to produce the desired pH. Softeners, enzyme, water soluble polymer, minors, e.g., perfume, optical brighteners, foam control agents, and the balance of water may then be added and mixing continued to form an aqueous dispersion. Granular forms of the detergent may be prepared by spray drying a liquid formulation to a water content of up to about 15 wt %, followed by the addition of any volatiles after spray dry processing.

The detergents of the invention are generally added to wash water at levels in the range of about 0.05 to 0.30 wt %. For conventional washing machines, detergents in the form of liquids are preferably added at levels in the range of from about 60 to 240 ml per load; powder detergents are preferably used at levels of about 60 to 300 grams per load.

The following examples are illustrative of the invention.

EXAMPLE 1

Three different liquid detergent formulations were prepared having a composition of main ingredients, by weight, as shown in Table 1. Formulation A is typical of a conventional detergent formulation containing zeolite builder, clay softener and formulated to a pH of about 8.2. Formulation B, a comparative composition, is free of Zeolite builder and contains citric acid (neutralized to potassium citrate) and is adjusted to a pH of about 6.0. Formulation C is within the present invention and is similar to Formulation B except that it contains a water soluble polyethylene glycol polymer having a molecular weight of about 4000 (PEG 4000). Ingredients were mixed in the order shown in Table 1.

TABLE 1

| MAIN COMPONENTS | A | B | C |
|---|---|---|---|
| AEOS | 8.00 | 8.50 | 8.50 |
| NI-3EO | 3.00 | 3.50 | 3.50 |
| Oleic Acid | 3.00 | 4.00 | 4.00 |
| Zeolite | 16.80 | 0.00 | 0.00 |
| Citric Acid | 1.82 | 5.00 | 5.00 |
| Dequest 2066 | 0.30 | 0.25 | 0.45 |
| KOH | (adjusted to pH) | (adjusted to pH) | (adjusted to pH) |
| Unactivated Ca Clay | 7.00 | 10.00 | 10.00 |
| Enzyme | 0.25 (Durazym 16L) | 0.8 (Alcalase 2.5L) | 0.8 (Alcalase 2.5) |
| PEG 4000 Polymer | No | No | 0.7 |
| Minors (Perfume, 08, Foam control . . . ) | | | |
| Water | Balance | Balance | Balance |
| pH (product as is) | 8.2 | 6.0 | 6.0 |

*AEOS - $C_{12}$–$C_{14}$ fatty alcohol ether sulfate (3EO).
NI-3EO - $C_{12}$–$C_{14}$ fatty alcohol containing 3 ethylene oxide (EO) groups.
Durazym ™ 16 L - Protease enzyme from Novo Industries
Alcalase ™ 2.5L - Protease enzyme from Novo Industries
Dequest ™ 2066 - Sodium salt of diethylene-triamine-pentamethylene phosphonic acid from Monsanto Chem. Co.

Both prototypes B and C are formulated at a slightly acid pH (pH=6) compared to the conventional liquid made in an alkaline medium (pH=8.2). The difference between prototypes B and C is the presence of 0.7 wt % of the polymer linker in C.

All products were tested in a European tumble type front loading washing machine (MIELE™) at 40° C. and at a 200 ppm $CaCO_3$ water hardness at a dosage level of about 180 ml. of liquid per load.

Figure 2:
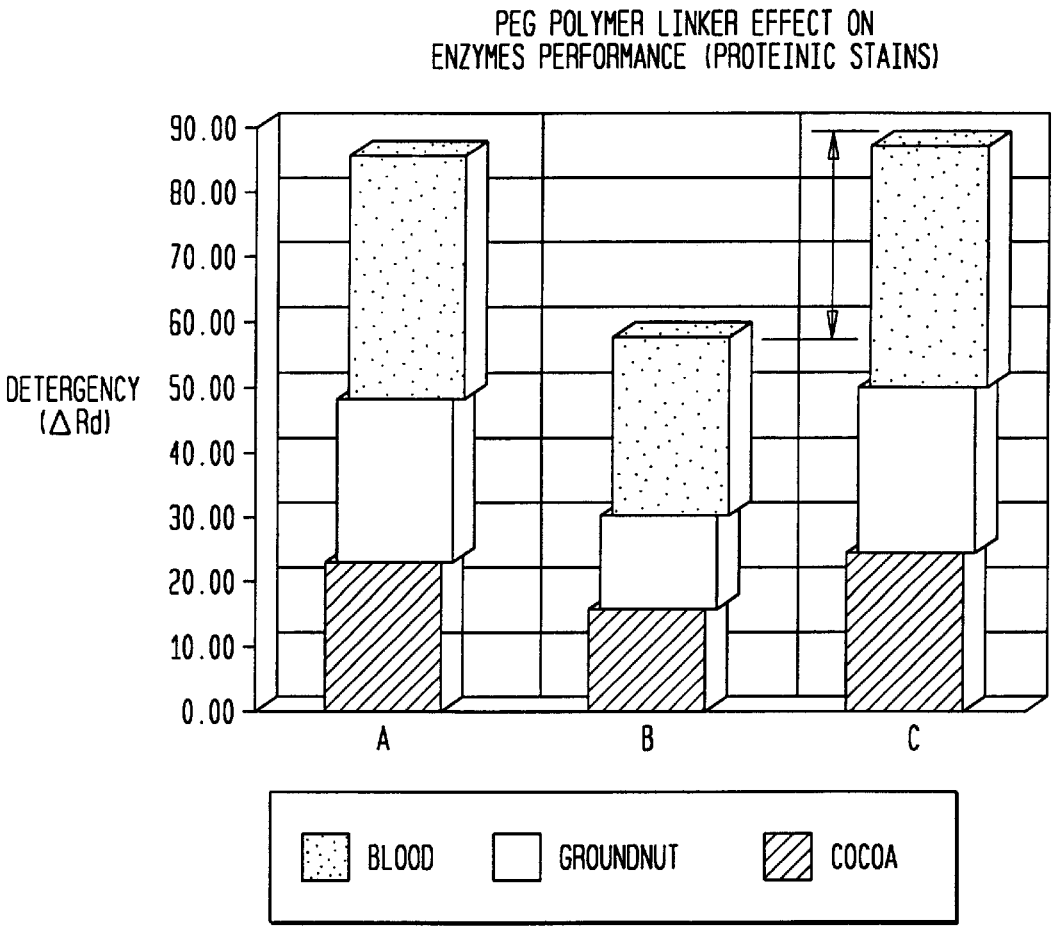

FIGS. 1 and 2 show respectively the greasy (sensitive to surfactants) and the bio-stains (sensitive to enzymes) removal performance of these products. The detergency expresses the difference (Δ Rd) between the reflectance Rd before washing and the reflectance Rd after washing. The term "Krefeld" refers to an artificial, particulate soiled cotton fabric (code WFK 10c) supplied by wfK-Testgewebe Gmbh of Germany.

In FIG. 1, it can be observed that the cleaning performance of the surfactants of formulation B on greasy stain is significantly lower compared to the commercial product A having alkaline pH. The incorporation of 0.7% PEC 4000 as in formulation C recovers back the greasy cleaning performance which was lost in the comparative formulation B and is due to the linker effect of the polymer.

FIG. 2 shows the cleaning performances of enzyme sensitive stains between the conventional product A and the detergent of the invention C. It can be observed that, due to the inappropriate medium—low pH—the enzymes in formulation B are not fully active resulting in a strong drop of soil removal performance on all stains: cocoa, groundnut/milk and blood/milk/ink. The incorporation of 0.7% PEG 4000 as in formulation C again corrects this tremendous weakness.

These results evidence that the PEG polymer linker not only can bind with conventional molecules such as surfactants and bring them close to the fabric surface, but can "link" also unconventional complex molecules such as enzymes.

EXAMPLE 2

Three different powder formulations were mixed in the laboratory and had a composition of main ingredients, by weight, as shown in Table 2. Formulation D is typical of a conventional powder formulation containing anionic surfactant (LAS), builder (STPP) enzyme and granulation aid (sodium sulfate), which is formulated to provide an alkaline pH in the wash water. Formulation E is a comparative composition similar to D except that it contains "SOKALAN" DCS from BASF corporation, which is a powdered mixture of adipic, glutaric and succinic acids, added to impart an acidic wash water pH after the powder is dispersed in the wash water medium.

Formulation F is within the scope of the present invention and is similar to Formulation E except that it also contains the polyethylene glycol linker polymer. The ingredients were mixed in the order shown in Table 2.

TABLE 2

| Composition* | D | E | F |
|---|---|---|---|
| LAS | 9.0 | 9.0 | 9.0 |
| STPP | 30.0 | 30.0 | 30.0 |
| MAXAPEM C-15 (enzyme) | 0.5 | 0.5 | 0.5 |
| Sodium sulfate | 60.5 | 55.4 | 52.9 |
| SOKALAN DCS | no | 5.1 | 5.1 |
| PEG 4000 | no | no | 2.5 |

*LAS - $C_{13}$–$C_{15}$ alkyl benzene sulfonate surfactant
STPP - sodium tripolyphosphate builder Cleaning performance of each product with respect to removal of bio and greasy stains from soiled cotton fabric was evaluated by washings in the Miele™ machine as described in Example 1 except the powder dosage level was 100 grams per washing. The detergency efficiency (Δ Rd) was measured as in Example 1 for each product before and after the wash and results are shown in Table 3.

TABLE 3

Soil Removal (Δ RD) for Compositions D, E, and F

| | D | E | F |
|---|---|---|---|
| Bio-stains (enzyme sensitive) | | | |
| Blood/milk/ink | 35 | 25 | 31 |
| Cocoa | 27 | 13 | 22 |
| Groundnut/milk | 24 | 19 | 22 |
| Greasy stains (surfactant sensitive) | | | |
| Skin soil | 18 | 16 | 21 |
| Krefeld | 11 | 11 | 11 |
| pH wash liquor | 8.1 | 6.8 | 6.8 |

These results demonstrate improved performance of the powder containing the linker polymer mainly with respect to bio stain removal in the slightly acidic medium even where an alkaline active enzyme is used. The performance of the surfactant is also significantly improved with respect to the removal of skin soils.

EXAMPLE 3

Two liquid detergent formulations were prepared having a composition, by weight, as shown in Table 4. The description of the particular surfactants, polymer and enzyme is the same as that noted in Table 1 of Example 1. Formulation G is a conventional liquid detergent formulation containing a low level of active ingredients, below 20% by weight of the composition. Formulation H is in accordance with the invention and is similar to Formulation G except that it contains polyethylene glycol polymer as a linker.

TABLE 4

| Component | G | H |
|---|---|---|
| AEOS | 6.3 | 6.3 |
| NI-3EO | 3.7 | 3.7 |
| Oleic Acid | 3.0 | 3.0 |
| Citric Acid | 3 | 3 |
| KOH | (adjusted to pH) | (adjusted to pH) |
| PEG 4000 Polymer | No | 1.0 |
| Enzyme | 0.6 (Alcalase 2.5L) | 0.6 (Alcalase 2.5L) |
| Water | Balance | Balance |
| pH (product as is) | 7.0 | 7.0 |
| pH (wash water) | 7.6 | 7.6 |

The cleaning performance of each product with respect to the removal of proteinic and greasy stains from soiled cotton fabrics was evaluated by washing in the Miele™ machine as described in Example 1. The detergency (Δ Rd) was measured as in Example 1 for each product before and after the wash and the results are shown in Table 5.

TABLE 5

Soil Removal (Δ Rd) for Compositions G and H

| Soil Removal (Δ Rd) | G | H |
|---|---|---|
| Greasy stains | | |
| Krefeld | 8.93 | 11.8 |
| Skin Soil | 14.7 | 15.7 |
| Salad Dressing | 3.9 | 4.25 |
| Proteinic stains | | |
| BMT | 25.8 | 26.2 |
| (Blood/milk/ink) | 22.4 | 35.2 |
| Cocoa | 19.3 | 20.4 |
| Ground Nut | 16.6 | 25.3 |
| Grass | | |

The results demonstrate the improved cleaning performance provided by Composition H for both the greasy stains as well as the proteinic stains. An improvement was noted for each greasy stain as well as proteinic stain with the improvement on Krefeld, cocoa and grass stains being particularly noteworthy.

What is claimed:

1. A detergent composition comprising a mixture of:

a) from about 5 to about 30 wt % of a surfactant comprising an anionic surfactant and optionally a nonionic surfactant; said detergent composition being free of a quaternary nitrogen containing cationic compound;

b) from about 0.01 to about 5 wt % of at least one enzyme; and c) from about 0.1 to about 5 wt % of a water soluble organic polymer which is polyethylene glycol having a molecular weight in the range of from about 200 to about 20,000 and which is miscible with or soluble in said surfactant; said composition providing a cleaning performance in the wash bath due to the presence of the organic polymer which is superior to the cleaning provided by an otherwise identical detergent composition which is free of said water soluble organic polymer.

2. The composition of claim 1 wherein said glycol has a molecular weight in the range of about 200 to 6,000.

3. The composition of claim 1 wherein said composition further comprises a vinylpyrrolidone polymer.

4. The composition of claim 1 wherein the surfactant comprises an alkali metal salt of a $C_8$–$C_{18}$ fatty alcohol polyethoxy sulfate.

5. The composition of claim 1 wherein the surfactant comprises a $C_6$ $C_{18}$ fatty alcohol polyethoxylate.

6. The composition of claim 5 wherein the polyethoxylate is of 1 to 11 ethylene oxide groups per mole of fatty alcohol.

7. The composition of claim 1 wherein the surfactant is a mixture of an anionic surfactant and a nonionic surfactant.

8. The composition of claim 1 which contains less than about 25%, by weight, of active ingredients.

9. The composition of claim 8 further containing sodium or potassium citrate.

10. The composition of claim 1 further containing from about 0.1 to about 10 wt % of at least one fatty acid containing from about 10 to 22 carbon atoms.

11. The composition of claim 10 wherein said fatty acid is oleic acid and coconut acid.

12. The composition of claim 1 which is in the form of a liquid and contains at least 20 wt % water.

13. The composition of claim 12 wherein said liquid contains from about 20 to 70 wt % water.

14. The composition of claim 1 wherein said detergent composition is in granular form.

15. A method for washing fabrics comprising forming a dilute aqueous solution of the detergent composition of claim 1 and subjecting fabric material to washing action in said dilute aqueous solution.

16. The method of claim 15 wherein said detergent composition is in the form of a liquid containing at least 20 wt % water.

* * * * *